US010262594B2

(12) United States Patent
Ma

(10) Patent No.: US 10,262,594 B2
(45) Date of Patent: Apr. 16, 2019

(54) PIXEL DRIVER CIRCUIT, PIXEL DRIVING METHOD, DISPLAY PANEL AND DISPLAY DEVICE

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/519,961

(22) PCT Filed: Aug. 29, 2016

(86) PCT No.: PCT/CN2016/097184
§ 371 (c)(1),
(2) Date: Apr. 18, 2017

(87) PCT Pub. No.: WO2017/118055
PCT Pub. Date: Jul. 13, 2017

(65) Prior Publication Data

US 2018/0301092 A1 Oct. 18, 2018

(30) Foreign Application Priority Data

Jan. 4, 2016 (CN) ..... 2016 1 0003695

(51) Int. Cl.
*G09G 3/3233* (2016.01)
*G09G 3/3258* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
None
See application file for complete search history.

(56) References Cited

U.S. PATENT DOCUMENTS

2008/0231625 A1 9/2008 Minami et al.
2009/0309503 A1 12/2009 Kim
2011/0227903 A1 9/2011 Choi
2012/0019498 A1 1/2012 Jeong
(Continued)

FOREIGN PATENT DOCUMENTS

CN 101609840 A 12/2009
CN 101609840 B 6/2011
(Continued)

OTHER PUBLICATIONS

International Search Report and Written Opinion for Application No. PCT/CN2016/097184, dated Nov. 25, 2016, 14 Pages.
(Continued)

*Primary Examiner* — Ifedayo B Iluyomade
(74) *Attorney, Agent, or Firm* — Brooks Kushman P.C.

(57) ABSTRACT

A pixel driver circuit includes a driving transistor, a first storage capacitor, a second storage capacitor, a threshold compensation unit, a data writing and a light-emitting control unit. The threshold compensation is configured to control the driving transistor to be turned on at a threshold compensation stage and discharge toward a resetting voltage line until the driving transistor is turned off. The data writing is configured to write a data voltage into a gate electrode of the driving transistor at a data writing stage. The light-emitting control is configured to enable the driving transistor to be turned on at a light-emitting stage, so as to drive a light-emitting element to emit light.

18 Claims, 5 Drawing Sheets

(52) U.S. Cl.
CPC ..... *G09G 2300/0852* (2013.01); *G09G 2300/0861* (2013.01); *G09G 2310/0251* (2013.01); *G09G 2310/0262* (2013.01); *G09G 2310/061* (2013.01); *G09G 2320/045* (2013.01)

(56) References Cited

U.S. PATENT DOCUMENTS

| | | | | |
|---|---|---|---|---|
| 2013/0043802 | A1 | 2/2013 | Han et al. | |
| 2014/0132642 | A1 | 5/2014 | Wu et al. | |
| 2014/0176520 | A1* | 6/2014 | Hwang | G09G 3/003 345/211 |
| 2014/0306867 | A1* | 10/2014 | Qing | G09G 3/3233 345/76 |

FOREIGN PATENT DOCUMENTS

| | | | |
|---|---|---|---|
| CN | 102930822 | A | 2/2013 |
| CN | 102956192 | A | 3/2013 |
| CN | 103886828 | A | 6/2014 |
| CN | 104751799 | A | 7/2015 |
| CN | 105096819 | A | 11/2015 |
| CN | 105427803 | A | 3/2016 |
| CN | 205282057 | U | 6/2016 |
| KR | 20080086371 | A | 9/2008 |

OTHER PUBLICATIONS

First Office Action for Chinese Application No. 201610003695.8, dated Jun. 2, 2017, 9 Pages.

* cited by examiner

PIXEL DRIVER CIRCUIT, PIXEL DRIVING METHOD, DISPLAY PANEL AND DISPLAY DEVICE

CROSS-REFERENCE TO RELATED APPLICATIONS

This application is the U.S. national phase of PCT Application No. PCT/CN2016/097184 filed on Aug. 29, 2016, which claims priority to Chinese Patent Application No. 201610003695.8 filed on Jan. 4, 2016, the disclosures of which are incorporated in their entirety by reference herein.

TECHNICAL FIELD

The present disclosure relates to the field of display technology, in particular to a pixel driver circuit, a pixel driving method, a display panel and a display device.

BACKGROUND

Currently, in the field of active-matrix organic light-emitting diode (AMOLED) display, especially in the design of a large-size substrate, an uneven current may flow through an organic light-emitting diode (OLED) due to unevenness and instability of a thin film transistor (TFT) on a back plate during the processing. In order to compensate for a threshold voltage (Vth) drift due to the TFT unevenness during the manufacture of the back plate, and a TFT characteristic drift due to a bias voltage after the operation for a long time period, an AMOLED compensation circuit is provided. In the case that the AMOLED tends to be of a larger size, a load applied to a signal line may increase and voltage attenuation may occur for a power source signal line, thus current evenness at a display region may be adversely affected.

For a conventional OLED compensation circuit, a desired data driving voltage range may be reduced along with an increase in the efficiency of a light-emitting element, and this will be beyond a driving capability of a driver Integrated Circuit (IC). However, it is unable for a conventional pixel driver circuit to compress the data at different compression ratios, so it is impossible to raise the data driving voltage range of the driver IC.

SUMMARY

A main object of the present disclosure is to provide a pixel driver circuit, a pixel driving method, a display panel and a display device, so as to compress data at different compression ratios, thereby to raise the data driving voltage range of the driver IC.

In one aspect, the present disclosure provides in some embodiments a pixel driver, including a driving transistor, a first storage capacitor, a second storage capacitor, a threshold compensation unit, a data writing unit and a light-emitting control unit. A gate electrode of the driving transistor is connected to a first end of the first storage capacitor, and a first electrode thereof is connected to a second end of the first storage capacitor. A first end of the second storage capacitor is configured to receive a first power source voltage, and a second end thereof is connected to the second end of the first storage capacitor. The threshold compensation unit is configured to, at a threshold compensation stage of each display period, enable the gate electrode of the driving transistor to receive a reference voltage and enable a second electrode of the driving transistor to be connected to a resetting voltage line, so as to enable the driving transistor to be turned on and discharged toward the resetting voltage line until the driving transistor is turned off. The data writing unit is configured to, at a data writing stage of each display period, write a data voltage into the gate electrode of the driving transistor. The light-emitting control unit is configured to, at a light-emitting stage of each display period, enable the first electrode of the driving transistor to receive the first power source voltage and enable the second electrode of the driving transistor to be connected to a light-emitting element, so as to enable the driving transistor to be turned on and drive the light-emitting element to emit light. A total amount of charges stored in the first storage capacitor and a total amount of charges stored in the second storage capacitor at the threshold compensation stage is equal to those at the data writing stage. An amount of charges stored in the first storage capacitor at the data writing stage is equal to an amount of charges stored in the first storage capacitor at the light-emitting control stage.

In a possible embodiment of the present disclosure, within each display period, the threshold compensation stage further includes a resetting stage. The threshold compensation unit is further configured to, at the resetting stage, enable the gate electrode of the driving transistor to receive the reference voltage and enable the second electrode of the driving transistor to receive a resetting voltage. The light-emitting control unit is further configured to, at the resetting stage, enable the first electrode of the driving transistor to receive the first power source voltage and enable the second electrode of the driving transistor to be connected to the light-emitting element. The driving transistor is in an amplified state or a saturation state at the resetting stage.

In a possible embodiment of the present disclosure, the light-emitting element includes an OLED, an anode of which is connected to the second electrode of the driving transistor through the light-emitting control unit, and a cathode of which is configured to receive a second power source voltage. At the resetting stage, a difference between the resetting voltage from the resetting voltage line and the second power source voltage is smaller than an on-state threshold voltage of the OLED.

In a possible embodiment of the present disclosure, the threshold compensation unit includes a first compensating transistor and a second compensating transistor. A gate electrode of the first compensating transistor is configured to receive a resetting control signal, a first electrode thereof is connected to the second electrode of the driving transistor, and a second electrode thereof is connected to the resetting voltage line. A gate electrode of the second compensating transistor is configured to receive the resetting control signal, a first electrode thereof is connected to the gate electrode of the driving transistor, and a second electrode thereof is configured to receive the reference voltage.

In a possible embodiment of the present disclosure, the data writing unit includes a data writing transistor, a gate electrode of which is configured to receive a scanning signal, a first electrode of which is connected to the gate electrode of the driving transistor, and a second electrode of which is configured to receive a data voltage.

In a possible embodiment of the present disclosure, the light-emitting control unit includes a first light-emitting control transistor and a second light-emitting control transistor. A gate electrode of the first light-emitting control transistor is configured to receive a light-emitting control signal, a first electrode thereof is configured to receive the first power source voltage, and a second electrode thereof is connected to the first electrode of the driving transistor. A gate electrode of the second light-emitting control transistor is configured to receive the light-emitting control signal, a first electrode thereof is connected to the second electrode of the driving transistor, and a second electrode thereof is connected to the light-emitting element.

In a possible embodiment of the present disclosure, the first compensating transistor and the second compensating transistor are both P-type transistors.

In a possible embodiment of the present disclosure, the data writing transistor is a P-type transistor.

In a possible embodiment of the present disclosure, the first light-emitting control transistor and the second light-emitting control transistor are both P-type transistors.

In another aspect, the present disclosure provides in some embodiments a pixel driving method applied to the above-mentioned pixel driver circuit, including steps of: at a threshold compensation stage of each display period, enabling, by a threshold compensation unit, a gate electrode of a driving transistor to receive a reference voltage, and enabling a second electrode of the driving transistor to be connected to a resetting voltage line, so as to enable the driving transistor to be turned on and discharged toward a start voltage line until the driving transistor is turned off; at a data writing stage of each display period, writing, by a data writing unit, a data voltage into the gate electrode of the driving transistor; and at a light-emitting stage of each display period, enabling, by a light-emitting control unit, a first electrode of the driving transistor to be driven at a first power source voltage, and enabling the second electrode of the driving transistor to be electrically connected to a light-emitting element, so as to enable the driving transistor to be turned on and drive the light-emitting element to emit light. A total amount of charges stored in a first storage capacitor and charges stored in a second storage capacitor at the threshold compensation stage is equal to that at the data writing stage. An amount of charges stored in the first storage capacitor at the data writing stage is equal to an amount of charges stored in the first storage capacitor at the light-emitting control stage.

In a possible embodiment of the present disclosure, within each display period, the threshold compensation stage further includes a resetting stage. The pixel driving method further includes, at the resetting stage of each display period, enabling, by the threshold compensation unit, the gate electrode of the driving transistor to receive the reference voltage and enabling the second electrode of the driving transistor to be electrically connected to the resetting voltage line, and enabling, by the light-emitting control unit, the first electrode of the driving transistor to receive the first power source voltage and enabling the second electrode of the driving transistor to be connected to the light-emitting element. The driving transistor is in an amplified state or a saturation state at the resetting stage.

In yet another aspect, the present disclosure provides in some embodiments a pixel driving method applied to the above-mentioned pixel driver circuit, including steps of: at a threshold compensation stage of each display period, enabling a light-emitting control signal and a scanning signal to be turn-off signals, and enabling a resetting control signal to be a turn-on signal, so as to enable a resetting voltage line to output a resetting voltage at a low level, enable a first light-emitting control transistor and a second light-emitting control transistor to be turned off, enable a first compensating transistor and a second compensating transistor to be turned on, and enable charges at a connection node between a first storage capacitor and a second storage capacitor to be discharged toward the resetting voltage line through a driving transistor and the first compensating transistor until a potential at a source electrode of the driving transistor is sufficient low to turn off the driving transistor; at a data writing stage of each display period, enabling the light-emitting control signal and the resetting control signal to be turn-off signals, and enabling the scanning signal to be a turn-on signal, so as to enable the first light-emitting control transistor and the second light-emitting control transistor to be turned off, enable the first compensating transistor and the second compensating transistor to be turned off, enable a data writing transistor to be turned on to write a data voltage into a gate electrode of the driving transistor, and enable the connection node between the first storage capacitor and the second storage capacitor to be in a floating state, a total amount of the charges stored in the first storage capacitor and the charges stored in the second storage capacitor at the threshold compensation stage being equal to that at the data writing stage; and at a light-emitting stage of each display period, enabling the scanning signal and the resetting control signal to be turn-off signals to turn off the first compensating transistor, the second compensating transistor and the data writing transistor, and enabling the light-emitting control signal to be a turn-on signal, so as to enable the first light-emitting control transistor and the second light-emitting control transistor to be turned on, enable a light-emitting element to be electrically connected to a second electrode of the driving transistor, enable a first power source voltage to be written into a connection node among a first electrode of the driving transistor, the first storage capacitor and the second storage capacitor, enable a first end of the second storage capacitor to receive the first power source voltage, and enable a node between the first storage capacitor and the gate electrode of the driving transistor to be in a floating stage, an amount of the charges stored in the first storage capacitor at the data writing stage being equal to an amount of the charges stored in the first storage capacitor at the light-emitting control stage so that a current flowing through the driving transistor at the light-emitting stage is merely associated with the data voltage, a capacitance of the first storage capacitor and a capacitance of the second storage capacitor.

In a possible embodiment of the present disclosure, within each display period, the threshold compensating stage further includes a resetting stage, and the pixel driving method further includes, at the resetting stage of each display period, enabling the light-emitting control signal and the resetting control signal to be turn-on signals, and enabling the scanning signal to a turn-off signal, so as to enable the first light-emitting control transistor and the second light-emitting control transistor to be turned on, enable the first compensating transistor and the second compensating transistor to be turned on, enable the data writing transistor to be turned off, enable the light-emitting element to be connected to the second electrode of the driving transistor, enable the resetting voltage to be written into the second electrode of the driving transistor, and enable the driving transistor to be in an amplified state or a saturation state.

In a possible embodiment of the present disclosure, in the case that the light-emitting element includes an OLED, an anode of which is connected to the second electrode of the driving transistor through the light-emitting control unit, and a cathode of which is configured to receive a second power source voltage, at the resetting stage, a difference between the resetting voltage from the resetting voltage line and the second power source voltage is smaller than an on-state threshold voltage of the OLED.

In still yet another aspect, the present disclosure provides in some embodiments a display panel including the above-mentioned pixel driver circuit.

In still yet another aspect, the present disclosure provides in some embodiments a display device including the above-mentioned display panel.

According to the pixel driver circuit, the pixel driving method, the display panel and the display device in the embodiments of the present disclosure, through the control over the amount of the charges stored in the first storage capacitor and the second storage capacitor at the threshold compensation stage and the light-emitting stage, the current flowing through the driving transistor for driving the light-emitting element at the light-emitting stage may be independent of a threshold voltage and a power source voltage of the driving transistor, and instead it may be merely associated with the data voltage, the reference voltage, the capacitance of the first storage capacitor and the capacitance of the second storage capacitor. In the case that the data voltage is equal to the reference voltage, it is able to output different currents by changing the capacitance of the first storage capacitor and the capacitance of the second storage capacitor, and compress the data at different compression ratios, thereby to increase the data driving voltage range of the driver IC.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
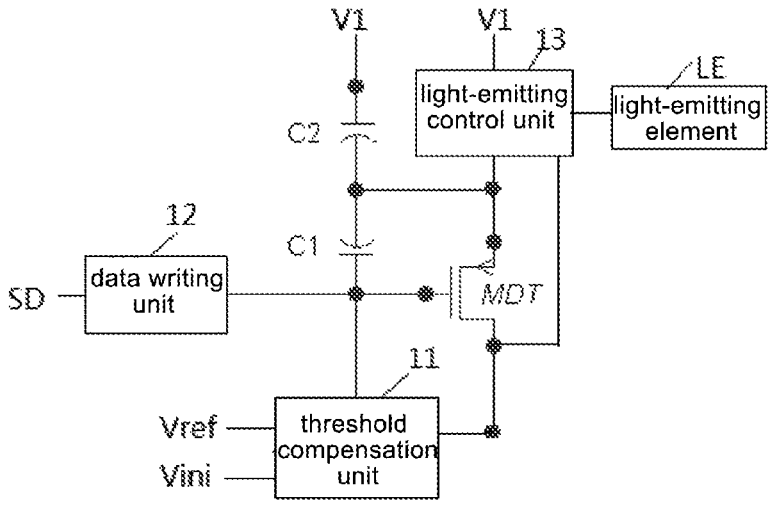
FIG. 1 is a schematic view showing a pixel driver circuit according to at least one embodiment of the present disclosure.

As shown in FIG. 1, the present disclosure provides in some embodiments a pixel driver circuit which includes a driving transistor MDT, a first storage capacitor C1, a second storage capacitor C2, a threshold compensation unit 11, a data writing unit 12 and a light-emitting control unit 13. A gate electrode of the driving transistor MDT is connected to a first end of the first storage capacitor C1, and a first electrode thereof is connected to a second end of the first storage capacitor C1. A first end of the second storage capacitor C2 is configured to receive a first power source voltage V1, and a second end thereof is connected to the second end of the first storage capacitor C1. The threshold compensation unit 11 is configured to, at a threshold compensation stage of each display period, control the gate electrode of the driving transistor MDT to receive a reference voltage Vref and enable a second electrode of the driving transistor MDT to be electrically connected to a resetting voltage line for outputting the resetting voltage Vini, so as to enable the driving transistor MDT to be turned on and discharge toward the resetting voltage line until the driving transistor MDT is turned off. The data writing unit 12 is configured to, at a data writing stage of each display period, write a data voltage SD into the gate electrode of the driving transistor MDT. The light-emitting control unit 13 is configured to, at a light-emitting stage of each display period, control the first electrode of the driving transistor MDT to receive the first power source voltage V1 and enable the second electrode of the driving transistor MDT to be eclectically connected to a light-emitting element LE, so as to enable the driving transistor MDT to be turned on and drive the light-emitting element LE to emit light. A total amount of charges stored in the first storage capacitor C1 and a total amount of charges stored in the second storage capacitor C2 at the threshold compensation stage is equal to those at the data writing stage. An amount of charges stored in the first storage capacitor C1 at the data writing stage is equal to an amount of charges stored in the first storage capacitor C1 at the light-emitting control stage.

In FIG. 1, the driving transistor MDT is a P-type transistor. At this time, the first electrode of the driving transistor MDT is a source electrode and a second electrode thereof is a drain electrode. During the implementation, the driving transistor MDT may also be an N-type transistor.

According to the pixel driver circuit in the embodiments of the present disclosure, through the control over the amount of the charges stored in the first storage capacitor and the amount of the charges stored in the second storage capacitor at the threshold compensation stage and the light-emitting stage, a current flowing through the driving transistor for driving the light-emitting element at the light-emitting stage may be independent of a threshold voltage of the driving transistor and a power source voltage, and instead it may be merely associated with the data voltage, the reference voltage, a capacitance of the first storage capacitor and a capacitance of the second storage capacitor. In the case that the data voltage and the reference voltage are the same, it is able to output different currents by changing the capacitance of the first storage capacitor and the capacitance of the second storage capacitor, and compress the data at different compression ratios, thereby to raise the data driving voltage range of a driver IC.

In the embodiments of eh present disclosure, all the transistors may be TFTs, or field effect transistors (FETs) or any other elements having an identical characteristic. In order to differentiate two electrodes other than the gate electrode from each other, one of them may be called as a source electrode and the other may be called as a drain electrode. In addition, depending on its characteristic, the transistor may be an N-type or a P-type transistor. For the driver circuit in the embodiments of the present disclosure, all the transistors are P-type transistors, and of course, N-type transistors may also be adopted, which also fall within the scope of the present disclosure.

In a possible embodiment of the present disclosure, within each display period, the threshold compensation stage further includes a resetting stage. The threshold compensation unit is further configured to, at the resetting stage, control the gate electrode of the driving transistor to receive the reference voltage and enable the second electrode of the driving transistor to be connected to the resetting voltage line. The light-emitting control unit is further configured to, at the resetting stage, control the first electrode of the driving transistor to receive the first power source voltage and enable the second electrode of the driving transistor to be electrically connected to the light-emitting element. The driving transistor is in an amplified state or a saturation state at the resetting stage.

In the embodiments of the present disclosure, in the case that the driving transistor is in the amplified state or the saturation state at the resetting stage, it is able to ensure a large current flowing through the driving transistor, so as to eliminate or reduce the characteristic drift of the driving transistor due to a stress at a small current in the case that a display panel is switched from a state where a low-brightness image is displayed for a long time period at the small current to a state where a high-brightness image is displayed at a large current, thereby to eliminate or attenuate a brightness trailing phenomenon due to the characteristic drift in the case that the display panel is switched from displaying a black image to displaying a white image.

In addition, in a possible embodiment of the present disclosure, at the resetting stage, the threshold compensation unit is further configured to, at the resetting stage, control the gate electrode of the driving transistor (i.e., the first end of the first storage capacitor) to receive the reference voltage, so as to enable the second electrode of the driving transistor (i.e., the second end of the first storage capacitor) to be electrically connected to the resetting voltage line, thereby to initialize a voltage across the first storage capacitor and prevent the writing of a current-frame signal from being adversely affected by a previous-frame signal.

In a possible embodiment of the present disclosure, the driving transistor may operate at a saturation zone at the resetting stage (i.e., the driving transistor is in the saturation state at the resetting stage). At this time, it is able to maximize the current flowing through the driving transistor.

Figure 2:
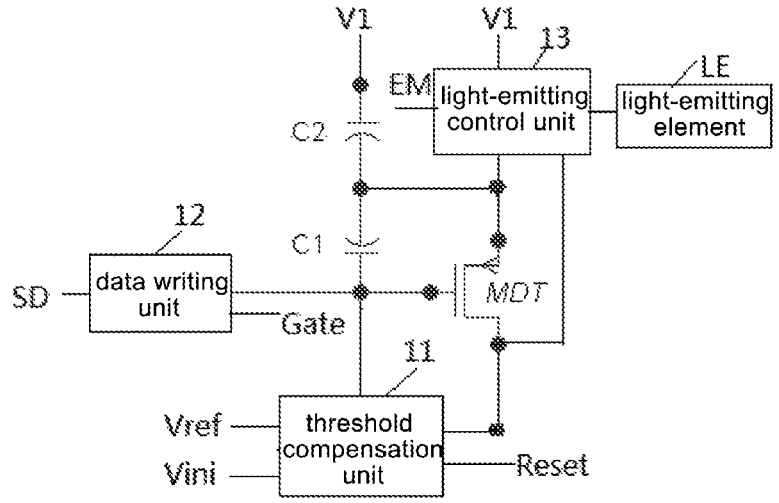
FIG. 2 is another schematic view showing the pixel driver circuit according to at least one embodiment of the present disclosure.

To be specific, as shown in FIG. 2, in the pixel driver circuit in the embodiments of the present disclosure, the threshold compensation unit 11 is configured to receive a resetting control signal Reset, the data writing unit 12 is configured to receive a scanning signal Gate, and the light-emitting control unit 13 is configured to receive a light-emitting control signal EM. The threshold compensation unit 11 is configured to, at the resetting stage and the threshold compensation stage of each display period, enable the gate electrode of the driving transistor MDT to receive the reference voltage Vref and enable the second electrode of the driving transistor MDT to receive the resetting voltage Vini under the control of the resetting control signal Reset. The data writing unit 12 is configured to, at the data writing stage of each display period, write the data voltage SD into the gate electrode of the driving transistor MDT under the control of the scanning signal Gate. The light-emitting control unit 13 is configured to, at the light-emitting stage of each display period, enable the first electrode of the driving transistor MDT to receive the first power source voltage V1 and enable the second electrode of the driving transistor MDT to be electrically connected to the light-emitting element LE under the control of the light-emitting control signal EM.

Figure 3:
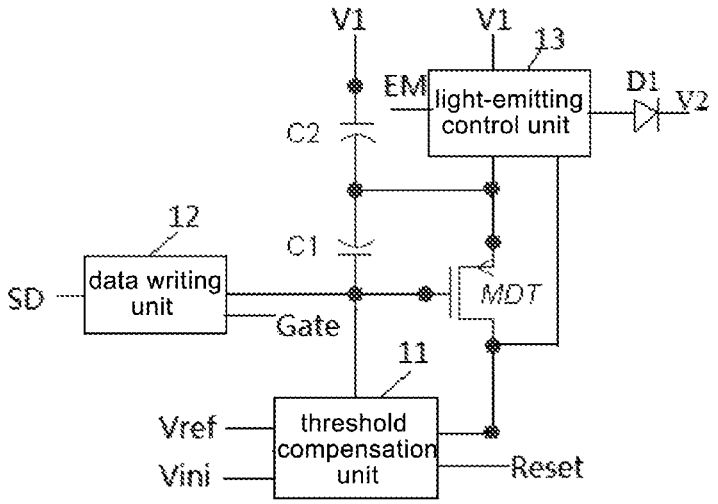
FIG. 3 is yet another schematic view showing the pixel driver circuit according to at least one embodiment of the present disclosure.

To be specific, as shown in FIG. 3, on the basis of the pixel driver circuit in FIG. 2, the light-emitting element may include an OLED D1, an anode of which is connected to the second electrode of the driving transistor MDT through the light-emitting control unit 13, and a cathode of which is configured to receive a second power source voltage V2.

At the resetting stage, a difference between the resetting voltage Vini from the resetting voltage line and the second power source voltage V2 is smaller than an on-state threshold voltage of the OLED D1. In this way, it is able to ensure the OLED D1 not to emit light at the resetting stage, thereby to improve the display quality in a dark state and improve the contrast.

To be specific, the threshold compensation unit includes a first compensating transistor and a second compensating transistor. A gate electrode of the first compensating transistor is configured to receive a resetting control signal, a first electrode thereof is connected to the second electrode of the driving transistor, and a second electrode thereof is connected to the resetting voltage line. A gate electrode of the second compensating transistor is configured to receive the resetting control signal, a first electrode thereof is connected to the gate electrode of the driving transistor, and a second electrode thereof is configured to receive the reference voltage.

To be specific, the data writing unit includes a data writing transistor, a gate electrode of which is configured to receive the scanning signal, a first electrode of which is connected to the gate electrode of the driving transistor, and a second electrode of which is configured to receive the data voltage.

To be specific, the light-emitting control unit includes a first light-emitting control transistor and a second light-emitting control transistor. A gate electrode of the first light-emitting control transistor is configured to receive the light-emitting control signal, a first electrode thereof is configured to receive the first power source voltage, and a second electrode thereof is connected to the first electrode of the driving transistor. A gate electrode of the second light-emitting control transistor is configured to receive the light-emitting control signal, a first electrode thereof is connected to the second electrode of the driving transistor, and a second electrode thereof is connected to the light-emitting element.

Figure 4A:
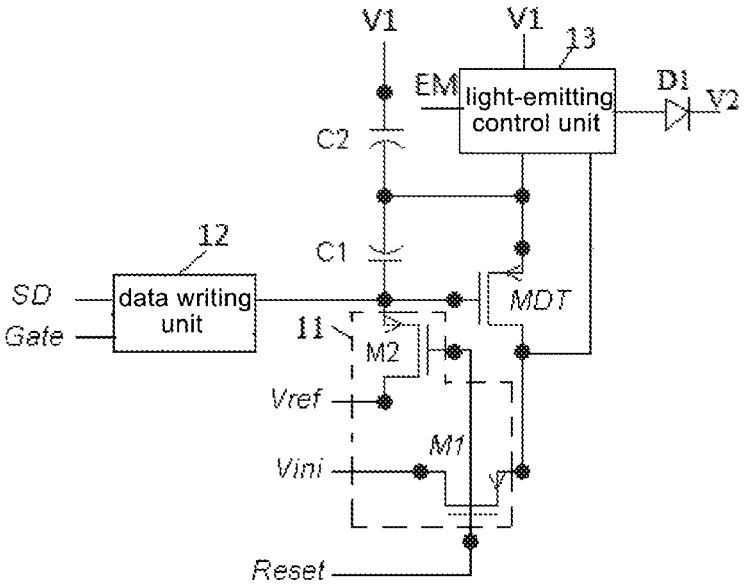
FIG. 4A is a schematic view showing the pixel driver circuit in FIG. 3 in the case that a threshold compensation unit includes a first compensating transistor and a second compensating transistor.

As shown in FIG. 4A, on the basis of the pixel driver circuit in FIG. 3, the threshold compensation unit 11 includes a first compensating transistor M1 and a second compensating transistor M2, which are both P-type transistors. A gate electrode of the first compensating transistor M1 is configured to receive the resetting control signal Reset, a source electrode thereof is connected to the drain electrode of the driving transistor MDT, and a drain electrode thereof is connected to the resetting voltage line for outputting the resetting voltage Vini. A gate electrode of the second compensating transistor M2 is configured to receive the resetting control signal Reset, a source electrode thereof is connected to the gate electrode of the driving transistor MDT, and a drain electrode thereof is configured to receive the reference voltage Vref.

Figure 4B:
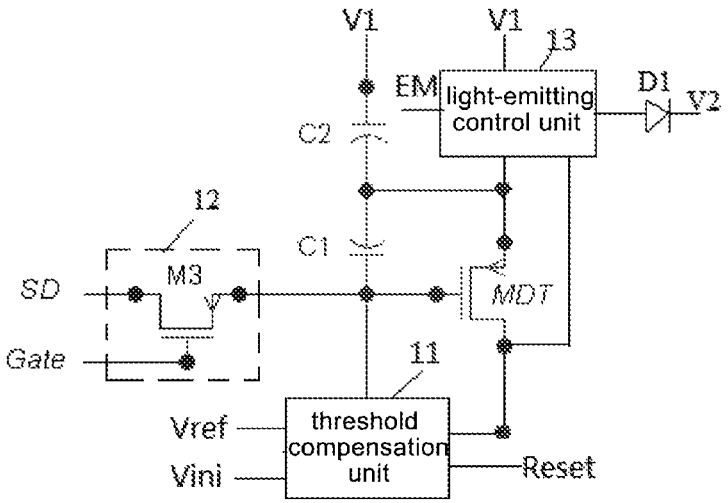
FIG. 4B is a schematic view showing the pixel driver circuit in FIG. 3 in the case that a data writing unit includes a data writing transistor.

As shown in FIG. 4B, on the basis of the pixel driver circuit in FIG. 3, the data writing unit 12 includes a data writing transistor M3, which is a P-type transistor. A gate electrode of the data writing transistor M3 is configured to receive the scanning signal Gate, a source electrode thereof is connected to the gate electrode of the driving transistor MDT, and a drain electrode thereof is configured to receive the data voltage SD.

Figure 4C:
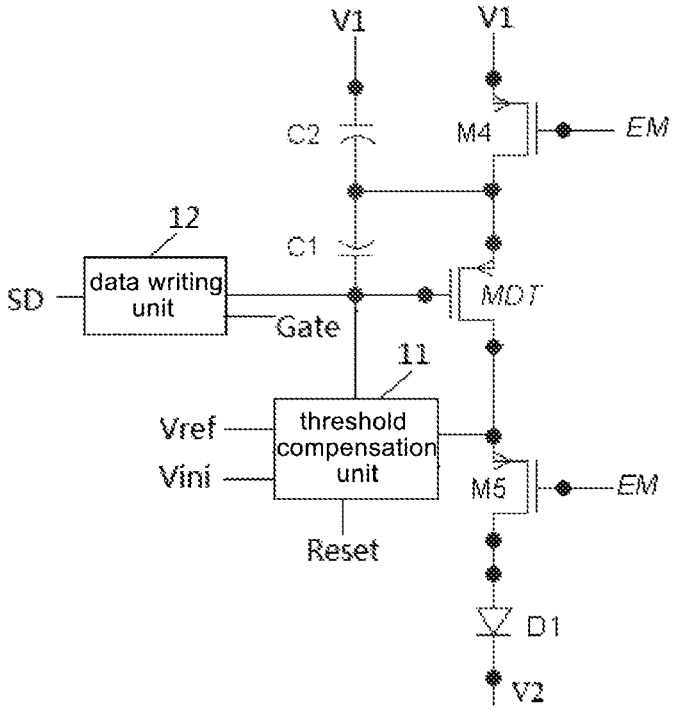
FIG. 4C is a schematic view showing the pixel driver circuit in FIG. 3 in the case that a light-emitting control unit includes a first light-emitting control transistor and a second light-emitting control transistor.

As shown in FIG. 4C, on the basis of the pixel driver circuit in FIG. 3, the light-emitting control unit includes a first light-emitting control transistor M4 and a second light-emitting control transistor M5. A gate electrode of the first light-emitting control transistor M4 is configured to receive the light-emitting control signal EM, a source electrode thereof is configured to receive the first power source voltage V1, and a drain electrode thereof is connected to the source electrode of the driving transistor MDT. A gate electrode of the second light-emitting control transistor M5 is configured to receive the light-emitting control signal EM, a source electrode thereof is connected to the drain electrode of the driving transistor MDT, and a drain electrode thereof is connected to the anode of the OLED D1.

The pixel driver circuit will be described hereinafter in conjunction with a specific embodiment.

Figure 5:
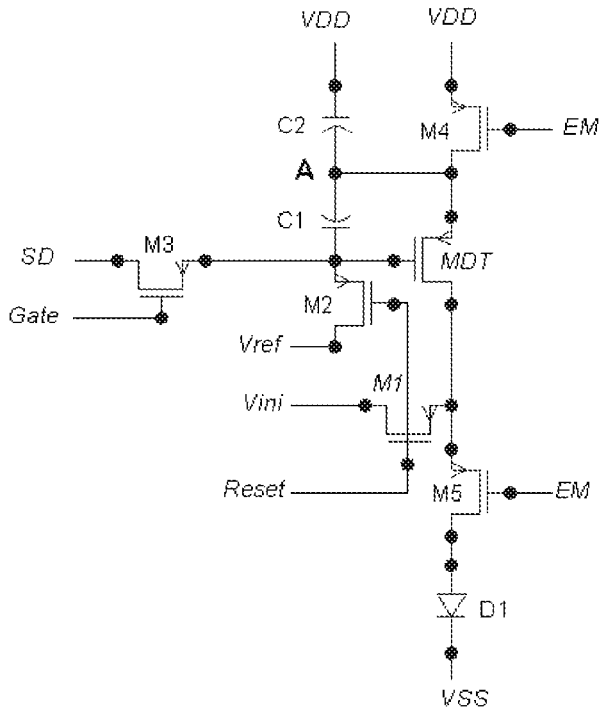
FIG. 5 is a circuit diagram of the pixel driver circuit according to one embodiment of the present disclosure.

As shown in FIG. 5, the pixel driver circuit includes the driving transistor MDT, the first storage capacitor C1, the second storage capacitor C2, the threshold compensation unit, the data writing unit and the light-emitting control unit. A gate electrode of the driving transistor MDT is connected to a first end of the first storage capacitor C1, and a source electrode thereof is connected to a second end of the first storage capacitor C1. A first end of the second storage capacitor C2 is configured to receive a high voltage VDD, and a second end thereof is connected to the second end of the first storage capacitor C1.

The threshold compensation unit includes a first compensating transistor M1 and a second compensating transistor M2. A gate electrode of the first compensating transistor M1 is configured to receive the resetting control signal Reset, a source electrode thereof is connected to a drain electrode of the driving transistor MDT, and a drain electrode thereof is connected to the resetting voltage line for outputting the resetting voltage Vini. A gate electrode of the second compensating transistor M2 is configured to receive the resetting control signal Reset, a source electrode thereof is connected to the gate electrode of the driving transistor MDT, and a drain electrode thereof is configured to receive the reference voltage Vref.

The data writing unit includes a data writing transistor M3, a gate electrode of which is configured to receive the scanning signal Gate, a source electrode of which is connected to the gate electrode of the driving transistor MDT, and a drain electrode of which is configured to receive the data voltage SD.

The light-emitting control unit includes a first light-emitting control transistor M4 and a second light-emitting control transistor M5. A gate electrode of the first light-emitting control transistor M4 is configured to receive the light-emitting control signal EM, a source electrode thereof is connected to receive the high voltage VDD, and a drain electrode thereof is connected to the source electrode of the driving transistor MDT. A gate electrode of the second light-emitting control transistor M5 is configured to receive the light-emitting control signal EM, a source electrode thereof is connected to the drain electrode of the driving transistor MDT, and a drain electrode thereof is connected to the anode of the OLED D1. The cathode of the OLED D1 is configured to receive a low voltage VSS. In FIG. 5, a connection node between the first storage capacitor C1 and the second storage capacitor C2 is a node A.

In FIG. 5, all the transistors are P-type transistors, and during the actual operation, these transistors may also be N-type transistors.

Figure 6:
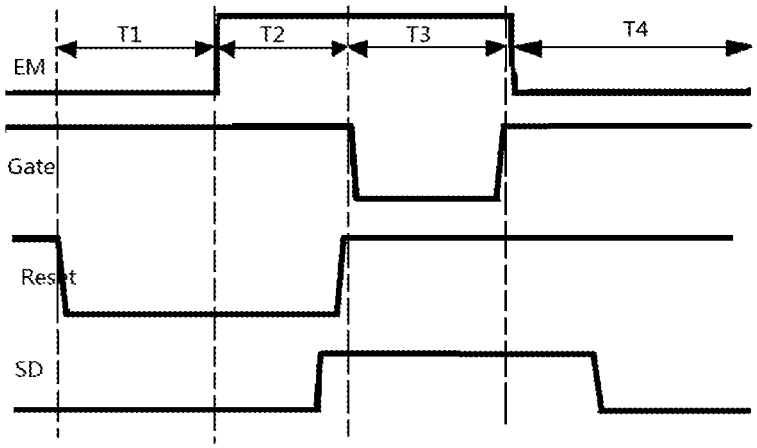
FIG. 6 is a sequence diagram of the pixel driver circuit in FIG. 5.

As shown in FIG. 6, during the operation of the pixel driver circuit in FIG. 5, at the resetting stage T1, EM is a low-voltage turn-on signal, Reset is a low-voltage turn-on signal, and Gate is a high-voltage turn-off signal. M4 and M5 under the control of EM are both turned on, and M1 and M2 under the control of Reset are turned on too. The anode of D1 is electrically connected to the drain electrode of MDT, so Vini is written into the drain electrode of MDT and the anode of D1, and thereby a potential at the anode of D1 is reset to Vini. In addition, a difference between Vini and VSS is preferably smaller than an on-state threshold voltage of D1, so as to ensure that D1 does not emit light at this time, thereby to improve the display quality in the dark state and improve the contrast. VDD is written into the source electrode of MDT, and meanwhile Vref is written into the gate electrode of MDT. A difference between Vref and VDD is just Vgs of MDT, so it is able to ensure a large current flowing through MDT, so as to eliminate or reduce the characteristic drift of MDT due to a stress at a small current in the case that a display panel is switched from a state where a low-brightness image is displayed for a long time period at the small current to a state where a high-brightness image is displayed at a large current, thereby to eliminate or attenuate a brightness trailing phenomenon due to the characteristic drift in the case that the display panel is switched from displaying a black image to displaying a white image. At this stage, the large current flowing through MDT depends on Vref and Vini. MDT may operate at an amplified zone or a saturation zone. Theoretically, MDT prefers to operate at the saturation zone, and at this time, it is able to maximize the current flowing through MDT.

At the resetting stage T1, the voltage across C1 may be reset, so as to prevent the writing of a current-frame signal from being adversely affected by a previous-frame signal.

At the threshold compensation stage T2, EM and Gate are both high-voltage turn-off signals, and Reset is a low-voltage turn-on signal. M4 and M5 under the control of EM are turned off, and M1 and M2 under the control of Reset are maintained in an on state. In this way, charges stored at a connection node (i.e., node A in FIG. 3) between C1 and C2 may be discharged through MDT and M1 toward the resetting voltage line for outputting a low-potential Vini until a potential at the source electrode of MDT is sufficient low to turn off MDT. At this time, for MDT, Vgs−Vth=0. Because Vg=Vref, Vs=Vg−Vth=Vref−Vth. In other words, a voltage across C1 is just equal to the threshold voltage Vth of MDT.

At the data writing stage T3, EM and Reset are both high-voltage turn-off signals, and Gate is a low-voltage turn-on signal. M4 and M5 under the control of EM are both turned off, and M1 and M2 under the control of Reset are turned off too. In addition, M3 under the control of Gate is in the on state, so SD is written into the gate electrode of MDT, i.e., a connection node between C1 and the gate electrode of MDT. For a series circuit consisting of C1 and C2, a voltage at a connection node between C1 and C2 is in a floating state, and a total amount of charges stored in C1 and C2 at the data writing stage T3 is equal to a total amount of charges stored in C1 and C2 at the threshold compensation stage T2. Presumed that a voltage at the connection node between C1 and C2 is X, a total amount of the charges stored in C1 and C2 before the change is equal to (Vref−

Vth−Vref)*C1+[VDD−(Vref−Vth)]*C2, and a total amount of the charges stored in C1 and C2 after the change is equal to (X−SD)*C1+(VDD−X)*C2. Based on a principle where the total amount of the charges remain unchanged before and after the change, it may be deduced that X=(Vref*C2−SD*C1)/(C2−C1)−Vth.

At the light-emitting stage T4, Gate and Reset are both high-voltage turn-off signals, so M1, M2 and M3 are all in off state. EM is a low-voltage turn-on signal, so M4 and M5 are turned on. In the case that M5 is turned on, the anode of D1 is electrically connected to the drain electrode of MDT, and in the case that M3 is turned on, VDD is written into the source electrode of MDT and the connection node between C1 and C2. Because the first end of C2 is configured to receive VDD, the capacitances of C1 and C2 may not be adversely affected by the change in the potential at the connection node between C1 and C2. At this time, the connection node between C1 and the gate electrode of MDT is in a floating state. Due to C1, the potential at the connection node between C1 and the gate electrode of MDT may change along with the potential at the connection node between C1 and C2, and before and after the change, the amount of the charges stored in C1 may remain unchanged (i.e., the amount of the charges stored in C1 at the data writing stage T3 is equal to that at the light-emitting stage T4).

The amount of the charges stored in C1 before the change is equal to (X−Vref)*C1=[(Vref*C2−SD*C1)/(C2−C1)−Vth−Vref]*C1, and the amount of the charges stored in C1 after the change (presumed that a potential at the gate electrode of MDT after the change is Y) is equal to (VDD−Y)*C1. Based on a principle of charge conservation, it may be deduced that Y=VDD+Vth+C2*(SD−Vref)/(C2−C1). Because MDT is in the saturation zone, it may be deduced in accordance with a formula for calculating a current flowing through a transistor in the saturation zone that Ids=½*K*(Vgs−Vth) 2=½*K*(VDD+Vth+C2*(SD−Vref)/(C2−C1)−VDD−Vth) 2=½*K*(C2*(SD−Vref)/(C2−C1))2, where Ids represents a drain-to-source current in the case that MDT operates in the saturation zone, K represents a current parameter and has a relatively stable value, i.e., it may be a constant, and C2/(C2−C1) represents a capacitance and may also be considered as a constant. In this regard, a value of Ids merely depends on the data voltage SD and the reference voltage Vref Vref is a direct current voltage signal, so the value of Ids is merely associated with the data voltage SD. Hence, for the circuit structure of the pixel driver circuit in FIG. 3, it is able to not only compensate for the threshold voltage of the driving transistor MDT, but also compensate for an IR drop on the power source signal VDD. In addition, it is able to able output different currents in accordance with a ratio of C2/(C2−C1) in the case of an identical data voltage, thereby to compress data at different compression ratios.

Figure 7:
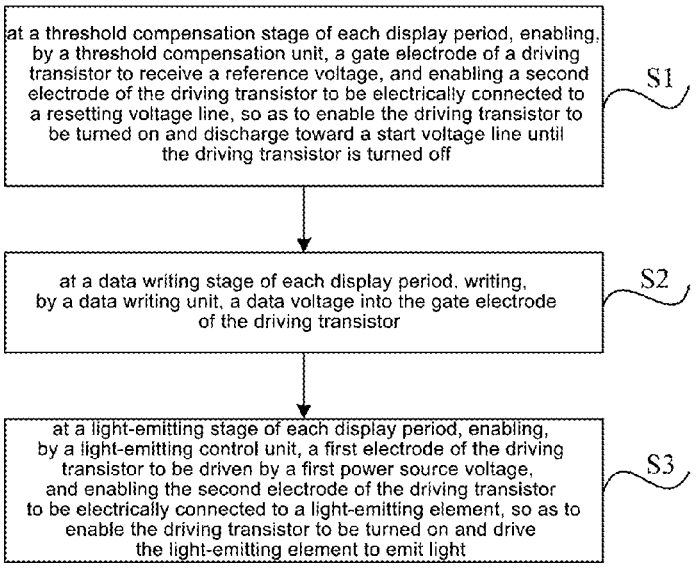
FIG. 7 is a flow chart of a pixel driving method according to at least one embodiment of the present disclosure.

As shown in FIG. 7, the present disclosure further provides in some embodiments a pixel driving method applied to the above-mentioned pixel driver circuit, including: a threshold compensation step S1 of, at a threshold compensation stage of each display period, controlling, by a threshold compensation unit, a gate electrode of a driving transistor to receive a reference voltage, and enabling a second electrode of the driving transistor to be electrically connected to a resetting voltage line, so as to enable the driving transistor to be turned on and discharge toward a start voltage line until the driving transistor is turned off; a data writing step S2 of, at a data writing stage of each display period, writing, by a data writing unit, a data voltage into the gate electrode of the driving transistor; and a light emitting step S3 of, at a light-emitting stage of each display period, enabling, by a light-emitting control unit, a first electrode of the driving transistor to be driven at a first power source voltage, and enabling the second electrode of the driving transistor to be electrically connected to a light-emitting element, so as to enable the driving transistor to be turned on and drive the light-emitting element to emit light. A total amount of charges stored in a first storage capacitor and charges stored in a second storage capacitor at the threshold compensation stage is equal to that at the data writing stage. An amount of charges stored in the first storage capacitor at the data writing stage is equal to an amount of charges stored in the first storage capacitor at the light-emitting control stage.

According to the pixel driving method in the embodiments of the present disclosure, through the control over the amount of the charges stored in the first storage capacitor and the second storage capacitor at the threshold compensation stage and the light-emitting stage, the current flowing through the driving transistor for driving the light-emitting element at the light-emitting stage may be independent of a threshold voltage of the driving transistor and a power source voltage, and instead it may be merely associated with the data voltage, the reference voltage, the capacitance of the first storage capacitor and the capacitance of the second storage capacitor. In the case that the data voltage and the reference voltage are the same, it is able to output different currents by changing the capacitance of the first storage capacitor and the capacitance of the second storage capacitor, and compress the data at different compression ratios.

Figure 8:
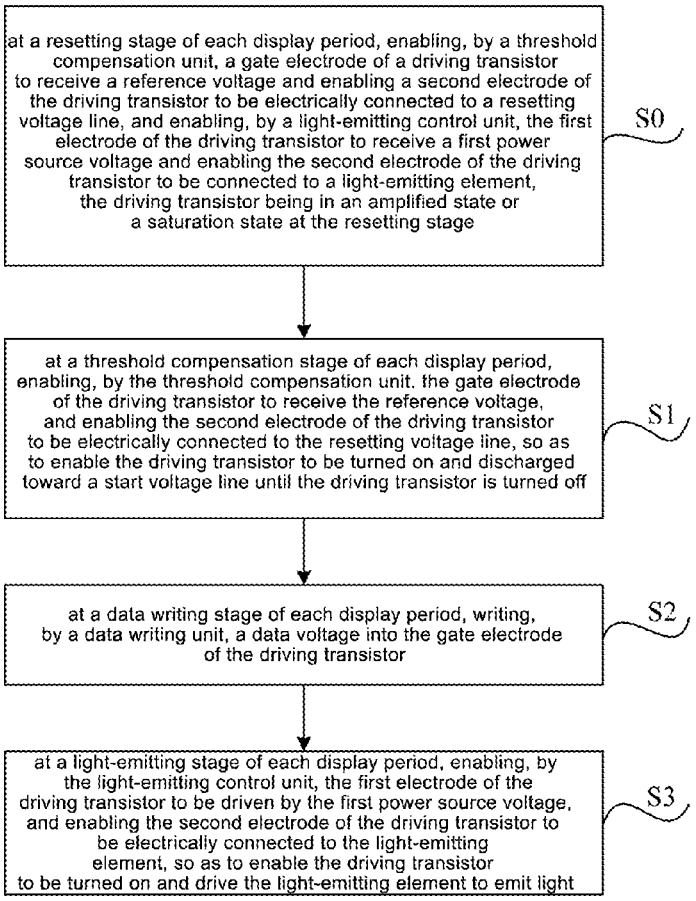
FIG. 8 is another flow chart of the pixel driving method according to at least one embodiment of the present disclosure.

In a possible embodiment of the present disclosure, within each display period, the threshold compensation stage further includes a resetting stage. As shown in FIG. 8, the pixel driving method further includes a resetting step S0 of, at the resetting stage of each display period, controlling, by the threshold compensation unit, the gate electrode of the driving transistor to receive the reference voltage and enabling the second electrode of the driving transistor to be electrically connected to the resetting voltage line, and enabling, by the light-emitting control unit, the first electrode of the driving transistor to receive the first power source voltage and enabling the second electrode of the driving transistor to be connected to the light-emitting element. The driving transistor is in an amplified state or a saturation state at the resetting stage.

In the embodiments of the present disclosure, in the case that the driving transistor is in the amplified state or the saturation state at the resetting stage, it is able to ensure a large current flowing through the driving transistor, so as to eliminate or reduce the characteristic drift of the driving transistor due to a stress at a small current in the case that a display panel is switched from a state where a low-brightness image is displayed for a long time period at the small current to a state where a high-brightness image is displayed at a large current, thereby to eliminate or attenuate a brightness trailing phenomenon due to the characteristic drift in the case that the display panel is switched from displaying a black image to displaying a white image.

In addition, in a possible embodiment of the present disclosure, at the resetting stage, the threshold compensation unit is further configured to control, at the resetting stage, the gate electrode of the driving transistor (i.e., the first end of the first storage capacitor) to receive the reference voltage, so as to enable the second electrode of the driving transistor (i.e., the second end of the first storage capacitor) to be electrically connected to the resetting voltage line, thereby to initialize a voltage across the first storage capacitor and prevent the writing of a current-frame signal from being adversely affected by a previous-frame signal.

The present disclosure further provides in some embodiments a pixel driving method which includes steps of: at a threshold compensation stage of each display period, enabling a light-emitting control signal and a scanning signal to be turn-off signals, and enabling a resetting control signal to be a turn-on signal, so as to enable a resetting voltage signal to output a resetting voltage at a low level, enable a first light-emitting control transistor and a second light-emitting control transistor to be turned off, enable a first compensating transistor and a second compensating transistor to be turned on, and enable charges in the connection node between a first storage capacitor and a second storage capacitor to be discharged toward the resetting voltage line through a driving transistor and the first compensating transistor until a potential at a source electrode of the driving transistor is sufficient low to turn off the driving transistor; at a data writing stage of each display period, enabling the light-emitting control signal and the resetting control signal to be turn-off signals, and enabling the scanning signal to be a turn-on signal, so as to enable the first light-emitting control transistor and the second light-emitting control transistor to be turned off, enable the first compensating transistor and the second compensating transistor to be turned off, enable a data writing transistor to be turned on to write a data voltage into a gate electrode of the driving transistor, and enable the connection node between the first storage capacitor and the second storage capacitor to be in a floating state, a total amount of the charges stored in the first storage capacitor and the charges stored in the second storage capacitor at the threshold compensation stage being equal to that at the data writing stage; and at a light-emitting stage of each display period, enabling the scanning signal and the resetting control signal to be turn-off signals to turn off the first compensating transistor, the second compensating transistor and the data writing transistor, and enabling the light-emitting control signal to be a turn-on signal, so as to enable the first light-emitting control transistor and the second light-emitting control transistor to be turned on, enable a light-emitting element to be electrically connected to a second electrode of the driving transistor, enable a first power source voltage to be written into a connection node among a first electrode of the driving transistor, the first storage capacitor and the second storage capacitor, enable a first end of the second storage capacitor to receive the first power source voltage, and enable a connection node between the first storage capacitor and the gate electrode of the driving transistor to be in a floating stage, an amount of the charges stored in the first storage capacitor at the data writing stage being equal to an amount of the charges stored in the first storage capacitor at the light-emitting control stage so that a current flowing through the driving transistor at the light-emitting stage is merely associated with the data voltage, a capacitance of the first storage capacitor and a capacitance of the second storage capacitor.

In a possible embodiment of the present disclosure, within each display period, the threshold compensating stage further includes a resetting stage. The pixel driving method further includes, at the resetting stage of each display period, enabling the light-emitting control signal and the resetting control signal to be turn-on signals, and enabling the scanning signal to a turn-off signal, so as to enable the first light-emitting control transistor and the second light-emitting control transistor to be turned on, enable the first compensating transistor and the second compensating transistor to be turned on, enable the data writing transistor to be turned off, enable the light-emitting element to be connected to the second electrode of the driving transistor, enable the resetting voltage to be written into the second electrode of the driving transistor, and enable the driving transistor to be in an amplified state or a saturation state. It is able to ensure a large current flowing through the driving transistor, so as to eliminate or reduce the characteristic drift of the driving transistor due to a stress at a small current in the case that a display panel is switched from a state where a low-brightness image is displayed for a long time period at the small current to a state where a high-brightness image is displayed at a large current, thereby to eliminate or attenuate a brightness trailing phenomenon due to the characteristic drift in the case that the display panel is switched from displaying a black image to displaying a white image.

In addition, in a possible embodiment of the present disclosure, at the resetting stage, the threshold compensation unit is further configured to enable, at the resetting stage, the gate electrode of the driving transistor (i.e., the first end of the first storage capacitor) to receive the reference voltage, so as to enable the second electrode of the driving transistor (i.e., the second end of the first storage capacitor) to be electrically connected to the resetting voltage line, thereby to initialize a voltage across the first storage capacitor and prevent the writing of a current-frame signal from being adversely affected by a previous-frame signal.

In a possible embodiment of the present disclosure, in the case that the light-emitting element includes an OLED, an anode of which is connected to the second electrode of the driving transistor through the light-emitting control unit, and a cathode of which is configured to receive a second power source voltage, at the resetting stage, a difference between the resetting voltage from the resetting voltage line and the second power source voltage is smaller than an on-state threshold voltage of the OLED, so as to ensure the OLED not emitting light at the resetting stage.

The present disclosure further provides in some embodiments a display panel including the above-mentioned pixel driver circuit.

The present disclosure further provides in some embodiments a display device including the above-mentioned display panel.

The above are merely the preferred embodiments of the present disclosure. Obviously, a person skilled in the art may make further modifications and improvements without departing from the spirit of the present disclosure, and these modifications and improvements shall also fall within the scope of the present disclosure.

What is claimed is:

1. A pixel driver circuit, comprising a driving transistor, a first storage capacitor, a second storage capacitor, a threshold compensation circuit, a data writing circuit and a light-emitting control circuit, wherein a gate electrode of the driving transistor is connected to a first end of the first storage capacitor, and a first electrode of the driving transistor is connected to a second end of the first storage capacitor;

a first end of the second storage capacitor is configured to receive a first power source voltage, and a second end of the second storage capacitor is connected to the second end of the first storage capacitor;

the threshold compensation circuit is configured to, at a threshold compensation stage of each display period, control the gate electrode of the driving transistor to receive a reference voltage and enable a second electrode of the driving transistor to be connected to a resetting voltage line, so as to enable the driving transistor to be turned on and discharge toward the resetting voltage line until the driving transistor is turned off;

the data writing circuit is configured to, at a data writing stage of each display period, write a data voltage into the gate electrode of the driving transistor;

the light-emitting control circuit is configured to, at a light-emitting stage of each display period, control the first electrode of the driving transistor to receive the first power source voltage and enable the second electrode of the driving transistor to be connected to a light-emitting element, so as to enable the driving transistor to be turned on and drive the light-emitting element to emit light;

a total amount of charges stored in the first storage capacitor and a total amount of charges stored in the second storage capacitor at the threshold compensation stage is equal to those at the data writing stage;

an amount of charges stored in the first storage capacitor at the data writing stage is equal to an amount of charges stored in the first storage capacitor at a light-emitting control stage;

within each display period, the threshold compensation stage further comprises a resetting stage;

the threshold compensation circuit is further configured to, at the resetting stage, control the gate electrode of the driving transistor to receive the reference voltage and control the second electrode of the driving transistor to receive a resetting voltage;

the light-emitting control circuit is further configured to, at the resetting stage, control the first electrode of the driving transistor to receive the first power source voltage and enable the second electrode of the driving transistor to be connected to the light-emitting element;

the driving transistor is in an amplified state or a saturation state at the resetting stage;

the light-emitting element comprises an organic light-emitting diode (OLED), an anode of the OLED is connected to the second electrode of the driving transistor through the light-emitting control circuit, and a cathode of the OLED is configured to receive a second power source voltage; and at the resetting stage, a difference between the resetting voltage from the resetting voltage line and the second power source voltage is smaller than an on-state threshold voltage of the OLED.

2. The pixel driver circuit according to claim 1, wherein the threshold compensation circuit comprises a first compensating transistor and a second compensating transistor;

a gate electrode of the first compensating transistor is configured to receive a resetting control signal, a first electrode of the first compensating transistor is connected to the second electrode of the driving transistor, and a second electrode of the first compensating transistor is connected to the resetting voltage line; and a gate electrode of the second compensating transistor is configured to receive the resetting control signal, a first electrode of the second compensating transistor is connected to the gate electrode of the driving transistor, and a second electrode of the second compensating transistor is configured to receive the reference voltage.

3. The pixel driver circuit according to claim 1, wherein the threshold compensation circuit comprises a first compensating transistor and a second compensating transistor;

a gate electrode of the first compensating transistor is configured to receive a resetting control signal, a first electrode of the first compensating transistor is connected to the second electrode of the driving transistor, and a second electrode of the first compensating transistor is connected to the resetting voltage line; and a gate electrode of the second compensating transistor is configured to receive the resetting control signal, a first electrode of the second compensating transistor is connected to the gate electrode of the driving transistor, and a second electrode of the second compensating transistor is configured to receive the reference voltage.

4. The pixel driver circuit according to claim 2, wherein the first compensating transistor and the second compensating transistor are both P-type transistors.

5. The pixel driver circuit according to claim 1, wherein the data writing circuit comprises a data writing transistor, a gate electrode of the data writing transistor is configured to receive a scanning signal, a first electrode of the data writing transistor is connected to the gate electrode of the driving transistor, and a second electrode of the data writing transistor is configured to receive a data voltage.

6. The pixel driver circuit according to claim 5, wherein the data writing transistor is a P-type transistor.

7. The pixel driver circuit according to claim 3, wherein the data writing circuit comprises a data writing transistor, a gate electrode of the data writing transistor is configured to receive a scanning signal, a first electrode of the data writing transistor is connected to the gate electrode of the driving transistor, and a second electrode of the data writing transistor is configured to receive a data voltage.

8. The pixel driver circuit according to claim 1, wherein the light-emitting control circuit comprises a first light-emitting control transistor and a second light-emitting control transistor;

a gate electrode of the first light-emitting control transistor is configured to receive a light-emitting control signal, a first electrode of the first light-emitting control transistor is configured to receive the first power source voltage, and a second electrode of the first light-emitting control transistor is connected to the first electrode of the driving transistor; and a gate electrode of the second light-emitting control transistor is configured to receive the light-emitting control signal, a first electrode of the second light-emitting control transistor is connected to the second electrode of the driving transistor, and a second electrode of the second light-emitting control transistor is connected to the light-emitting element.

9. The pixel driver circuit according to claim 8, wherein the first light-emitting control transistor and the second light-emitting control transistor are both P-type transistors.

10. The pixel driver circuit according to claim 7, wherein the light-emitting control circuit comprises a first light-emitting control transistor and a second light-emitting control transistor;

a gate electrode of the first light-emitting control transistor is configured to receive a light-emitting control signal, a first electrode of the first light-emitting control transistor is configured to receive the first power source voltage, and a second electrode of the first light-emitting control transistor is connected to the first electrode of the driving transistor; and a gate electrode of the second light-emitting control transistor is configured to receive the light-emitting control signal, a first electrode of the second light-emitting control transistor is connected to the second electrode of the driving transistor, and a second electrode of the second light-emitting control transistor is connected to the light-emitting element.

11. A pixel driving method applied to the pixel driver circuit according to claim 1, comprising:

at a threshold compensation stage of each display period, controlling, by a threshold compensation circuit, a gate electrode of a driving transistor to receive a reference voltage, and enabling a second electrode of the driving transistor to be connected to a resetting voltage line, so as to enable the driving transistor to be turned on and discharge toward a start voltage line until the driving transistor is turned off;

at a data writing stage of each display period, writing, by a data writing circuit, a data voltage into the gate electrode of the driving transistor; and at a light-emitting stage of each display period, enabling, by a light-emitting control circuit, a first electrode of the driving transistor to be driven by a first power source voltage, and enabling the second electrode of the driving transistor to be connected to a light-emitting element, so as to enable the driving transistor to be turned on and drive the light-emitting element to emit light, wherein a total amount of charges stored in a first storage capacitor and charges stored in a second storage capacitor at the threshold compensation stage is equal to that at the data writing stage; and an amount of charges stored in the first storage capacitor at the data writing stage is equal to an amount of charges stored in the first storage capacitor at the light-emitting control stage.

12. The pixel driving method according to claim 11, wherein within each display period, the threshold compensation stage further comprises a resetting stage;

the pixel driving method further comprises, at a resetting stage of each display period, controlling, by the threshold compensation circuit, the gate electrode of the driving transistor to receive the reference voltage and enabling the second electrode of the driving transistor to be connected to the resetting voltage line, and controlling, by the light-emitting control circuit, the first electrode of the driving transistor to receive the first power source voltage and enabling the second electrode of the driving transistor to be connected to the light-emitting element; and the driving transistor is in an amplified state or a saturation state at the resetting stage.

13. A pixel driving method applied to the pixel driver circuit according to claim 10, comprising:

at a threshold compensation stage of each display period, enabling a light-emitting control signal and a scanning signal to be turn-off signals, and enabling a resetting control signal to be a turn-on signal, so as to enable a resetting voltage line to output a resetting voltage at a low level, enable a first light-emitting control transistor and a second light-emitting control transistor to be turned off, enable a first compensating transistor and a second compensating transistor to be turned on, and enable charges at a connection node between a first storage capacitor and a second storage capacitor to be discharged toward the resetting voltage line through a driving transistor and the first compensating transistor until a potential at a source electrode of the driving transistor is sufficient low to turn off the driving transistor;

at a data writing stage of each display period, enabling the light-emitting control signal and the resetting control signal to be turn-off signals, and enabling the scanning signal to be a turn-on signal, so as to enable the first light-emitting control transistor and the second light-emitting control transistor to be turned off, enable the first compensating transistor and the second compensating transistor to be turned off, enable a data writing transistor to be turned on to write a data voltage into a gate electrode of the driving transistor, and enable the connection node between the first storage capacitor and the second storage capacitor to be in a floating state, a total amount of the charges stored in the first storage capacitor and the charges stored in the second storage capacitor at the threshold compensation stage being equal to that at the data writing stage; and at a light-emitting stage of each display period, enabling the scanning signal and the resetting control signal to be turn-off signals to turn off the first compensating transistor, the second compensating transistor and the data writing transistor, and enabling the light-emitting control signal to be a turn-on signal, so as to enable the first light-emitting control transistor and the second light-emitting control transistor to be turned on, enable a light-emitting element to be electrically connected to a second electrode of the driving transistor, enable a first power source voltage to be written into a connection node among a first electrode of the driving transistor, the first storage capacitor and the second storage capacitor, enable a first end of the second storage capacitor to receive the first power source voltage, and enable a connection node between the first storage capacitor and the gate electrode of the driving transistor to be in a floating stage, an amount of the charges stored in the first storage capacitor at the data writing stage being equal to an amount of the charges stored in the first storage capacitor at the light-emitting control stage so that a current flowing through the driving transistor at the light-emitting stage is merely associated with the data voltage, a capacitance of the first storage capacitor and a capacitance of the second storage capacitor.

14. The pixel driving method according to claim 13, wherein within each display period, the threshold compensating stage further comprises a resetting stage, and the pixel driving method further comprises, at the resetting stage of each display period, enabling the light-emitting control signal and the resetting control signal to be turn-on signals, and enabling the scanning signal to a turn-off signal, so as to enable the first light-emitting control transistor and the second light-emitting control transistor to be turned on, enable the first compensating transistor and the second compensating transistor to be turned on, enable the data writing transistor to be turned off, enable the light-emitting element to be connected to the second electrode of the driving transistor, enable the resetting voltage to be written into the second electrode of the driving transistor, and enable the driving transistor to be in an amplified state or a saturation state.

15. The pixel driving method according to claim 14, wherein the light-emitting element includes an organic light-emitting diode (OLED), an anode of the OLED is connected to the second electrode of the driving transistor through the light-emitting control circuit, and a cathode of the OLED is configured to receive a second power source voltage, at the resetting stage, a difference between the resetting voltage from the resetting voltage line and the second power source voltage is smaller than an on-state threshold voltage of the OLED.

16. A display panel comprising the pixel driver circuit according to claim 1.

17. A display device comprising the display panel according to claim 16.

18. A pixel driving method applied to a pixel driver circuit, the pixel driver circuit comprising a driving transistor, a first storage capacitor, a second storage capacitor, a threshold compensation circuit, a data writing circuit and a light-emitting control circuit, wherein a gate electrode of the driving transistor is connected to a first end of the first storage capacitor, and a first electrode of the driving transistor is connected to a second end of the first storage capacitor;

a first end of the second storage capacitor is configured to receive a first power source voltage, and a second end of the second storage capacitor is connected to the second end of the first storage capacitor;

the threshold compensation circuit is configured to, at a threshold compensation stage of each display period, control the gate electrode of the driving transistor to receive a reference voltage and enable a second electrode of the driving transistor to be connected to a resetting voltage line, so as to enable the driving transistor to be turned on and discharge toward the resetting voltage line until the driving transistor is turned off;

the data writing circuit is configured to, at a data writing stage of each display period, write a data voltage into the gate electrode of the driving transistor;

the light-emitting control circuit is configured to, at a light-emitting stage of each display period, control the first electrode of the driving transistor to receive the first power source voltage and enable the second electrode of the driving transistor to be connected to a light-emitting element, so as to enable the driving transistor to be turned on and drive the light-emitting element to emit light;

a total amount of charges stored in the first storage capacitor and a total amount of charges stored in the second storage capacitor at the threshold compensation stage is equal to those at the data writing stage; and an amount of charges stored in the first storage capacitor at the data writing stage is equal to an amount of charges stored in the first storage capacitor at a light-emitting control stage, the pixel driving method comprising:

at a threshold compensation stage of each display period, controlling, by a threshold compensation circuit, a gate electrode of a driving transistor to receive a reference voltage, and enabling a second electrode of the driving transistor to be connected to a resetting voltage line, so as to enable the driving transistor to be turned on and discharge toward a start voltage line until the driving transistor is turned off;

at a data writing stage of each display period, writing, by a data writing circuit, a data voltage into the gate electrode of the driving transistor; and at a light-emitting stage of each display period, enabling, by a light-emitting control circuit, a first electrode of the driving transistor to be driven by a first power source voltage, and enabling the second electrode of the driving transistor to be connected to a light-emitting element, so as to enable the driving transistor to be turned on and drive the light-emitting element to emit light, within each display period, the threshold compensation stage further comprises a resetting stage, the pixel driving method further comprises, at a resetting stage of each display period, controlling, by the threshold compensation circuit, the gate electrode of the driving transistor to receive the reference voltage and enabling the second electrode of the driving transistor to be connected to the resetting voltage line, and controlling, by the light-emitting control circuit, the first electrode of the driving transistor to receive the first power source voltage and enabling the second electrode of the driving transistor to be connected to the light-emitting element, and the driving transistor is in an amplified state or a saturation state at the resetting stage, wherein the light-emitting element comprises an organic light-emitting diode (OLED), an anode of the OLED is connected to the second electrode of the driving transistor through the light-emitting control circuit, and a cathode of the OLED is configured to receive a second power source voltage; and at the resetting stage, a difference between the resetting voltage from the resetting voltage line and the second power source voltage is smaller than an on-state threshold voltage of the OLED.

* * * * *